US012447398B2

(12) United States Patent
Lauby et al.

(10) Patent No.: US 12,447,398 B2
(45) Date of Patent: Oct. 21, 2025

(54) DICE

(71) Applicant: Precision Play Dice LLC, St. Louis, MO (US)

(72) Inventors: Tyson J. Lauby, St. Louis, MO (US); Michael G. Allman, Cottleville, MO (US)

(73) Assignee: Precision Play Dice LLC, St. Louis, MO (US)

( * ) Notice: Subject to any disclaimer, the term of this patent is extended or adjusted under 35 U.S.C. 154(b) by 526 days.

(21) Appl. No.: 17/992,780

(22) Filed: Nov. 22, 2022

(65) Prior Publication Data

US 2024/0165499 A1 May 23, 2024

(51) Int. Cl.
*A63F 9/04* (2006.01)

(52) U.S. Cl.
CPC ..... *A63F 9/0415* (2013.01); *A63F 9/0413* (2013.01); *A63F 2009/0422* (2013.01); *A63F 2009/0431* (2013.01); *A63F 2009/0435* (2013.01); *A63F 2009/0437* (2013.01); *A63F 2009/0484* (2013.01)

(58) Field of Classification Search
CPC ..... A63F 9/0413; A63F 9/0415
USPC ..... D21/372; 273/216
See application file for complete search history.

(56) References Cited

U.S. PATENT DOCUMENTS

| | | | | |
|---|---|---|---|---|
| 5,909,874 A | 6/1999 | Daniel et al. | | |
| 10,946,267 B2 | 3/2021 | Pater et al. | | |
| 2008/0211182 A1* | 9/2008 | Hochstrasser | A63F 9/0415 | 273/146 |
| 2009/0206548 A1* | 8/2009 | Hawkins | A63F 9/0468 | 273/146 |
| 2018/0361229 A1* | 12/2018 | Pater | A63F 9/0415 | |
| 2022/0395745 A1* | 12/2022 | Dempsey | A63F 9/0415 | |
| 2024/0100413 A1* | 3/2024 | Milo | A63F 9/0415 | |

FOREIGN PATENT DOCUMENTS

| | | | | |
|---|---|---|---|---|
| FR | 1295569 A * | 6/1962 | | |
| GB | 195757 A * | 4/1923 | A63F 9/0415 | |
| KR | 20040066659 A | 7/2004 | | |

OTHER PUBLICATIONS

Easy Roller https://web.archive.org/web/20211026075405/https://easyrollerdice.com/products/hollow-dice-of-devine-retribution-legendary-bronze (Year: 2021).*

KLEC https://www.kickstarter.com/projects/msgames/klec-a-polyhedral-metal-dice-set-inspired-by-caged-jail (Year: 2021).*

Nimbus https://web.archive.org/web/20220521085739/https://www.norsefoundry.com/products/nimbus-tm-precision-cnc-tungsten-dice-set (Year: 2022).*

Bronze-Nimbus 7 Piece RPG Set True Metal Dice, Norse Foundry [Retrieved on Sep. 14, 2023]. Retrieved from the Internet: URL<https://www.norsefoundry.com/products/nimbus-precision-cnc-bronze-dice-set?variant=40051970769055&currency=USD&utm_medium=product_sync&utm_source=google&utm_content=sag_organic&utm_campaign=sag_organic&gclid=Cj0KCQjw0bunBhD9ARIsAAZI0E397nBxrNNI8jLbgAlkvlcTc0KF8dXJbgeRPeBTt5gDl-GaeuKyLH4aApNMEALw_wcB>, 3 pages.

(Continued)

*Primary Examiner* — Kyle R Grabowski
(74) *Attorney, Agent, or Firm* — Lewis Rice LLC

(57) ABSTRACT

Dice which have the exterior form of regular polyhedrons, but are not solid polyhedrons. Instead, the dice, when viewed externally, are in the form of skeletal polyhedrons with floating faces. The dice also include a solid core surrounding their center which can serve to improve tumbling behavior.

19 Claims, 6 Drawing Sheets

(56) References Cited

OTHER PUBLICATIONS

KLEC—A Polyhedral Metal Dice Set Inspired by Caged Jail, Moonmares Games, Kickstarter, Last Updated: Jul. 19, 2023, Retrieved from the Internet: <URL:https://www.kickstarter.com/projects/msgames/klec-a-polyhedral-metal-dice-set-inspired-by-caged-jail>, 12 pages.
Shapeways, Dice Collector [Retrieved on Sep. 14, 2023]. Retrieved from the Internet <URL:https://www.dicecollector.com/THE_DICE_THEME_SHAPEWAYS.html>, 27 pages.
Stainless Steel Caged Set of 7, Level Up Dice [Retrieved on Sep. 14, 2023]. Retrieved from the Internet: URL<https://usa.levelupdice.net/products/USA-stainless-steel-caged-set-of-7>, 3 pages.
International Search Report and Written Opinion in PCT/US2023/080967, mailed Mar. 28, 2024, 8 pages.

* cited by examiner

SECTION A-A

SECTION A-A

SECTION A-A

DICE

BACKGROUND OF THE INVENTION

Field of the Invention

The present disclosure relates to systems and methods for making dice and to dice which have a generally hollow skeletal structure with a floating face but still provide a high level of randomness in rolling.

Description of the Related Art

Dice are a near ubiquitous gaming implement in the modern world. The vast majority of board games, role-playing games, tabletop war-games, and the like are reliant on dice for providing a level of randomness to play. Further, modern casino games such as Craps as well as less well-known games such as Klondike or Hazard utilize dice to provide the element of chance necessary for them to work for modern gambling. While modern dice are ubiquitous, dice are, in fact, one of the oldest gaming implements known to mankind.

While originally credited as having been developed in ancient Greece, archeological findings have now dated dice to much earlier. Dice of a form identifiable as similar to the modern can be dated to 2000 BCE. Even before there existed what we would call dice and gaming today, the throwing of objects which could have different orientations when they came to rest is likely even older. Bones and particularly knucklebones were likely thrown by prehistoric human societies for religious purposes, to make decisions, or to predict the future.

Dice are so common because they are an incredibly simple device to produce randomness and randomness is an essential element of much modern play and gambling. Their randomness is also what likely brought them their significance in prediction and religion. When an outcome of an action is completely unknown to a human, it is easy for that human to ascribe that outcome as indicating the will of a higher power that can control the outcome and dice existed for thousands of years before the mathematics of probability was first understood.

The ability to produce randomness is so important to human society because the human mind is incredibly good at finding and recognizing patterns. The human neocortex acts to detects patterns and is so sophisticated at it that modern computer pattern recognition systems typically pale in comparison. In game play, and particularly in competitive play or wagering, it is important that the outcome of some actions not be known in advance for the game to be fun or the wager to be fair. Thus, while logic games and the like which have definitive answers and patterns have their place, much play, and wagering, requires introduction of randomness or chance to work.

While there are more modern methods of obtaining random values that can be used whenever a truly random value is required, for example, using radioactive decay, these systems and methods are often much more expensive and complicated than dice. Further, many systems which appear to generate randomness (for example, certain digital random number generators) are not actually random at all and players can detect, and use, the patterns. For all these reasons and many more, dice have hung on as a valuable tool in modern gaming and wagering.

At their simplest, a die can be thought of as simply an object which can be thrown and which, when it comes to rest, will have one of a variety of orientations which orientation is readily discernable. Elements of randomness are introduced due to it being typically impossible to control all variables related to the dice throw (and the tumbling behavior of the die over a surface) so that which orientation results from any one throw cannot be accurately predicted. While the orientation of any one throw cannot be predicted accurately, another advantage of dice is that the likelihood (statistical probability) of any value coming up in any throw is actually well-known (at least in modern times) and mathematically immutable.

Thus, dice typically do not actually produce truly random values. Instead, any die actually produces a single random value (for any one throw) but over time should produce all available values at a statistically definable rate based on the die's design. This makes it is easy to create odds around the use of dice to determine an outcome or to use the dice throw to generate gaming conditions. Each throw of the dice is random, but over time the outcome of throws should approach statistical predictions. Further, the available values for each throw are also well-defined ahead of time.

This phenomenon is particularly valuable when multiple dice are used together as this allows for them to be used individually or for their sum to be used. The sum of two dice (having numbered faces) follows a normal distribution about the center (e.g. 7 for two 6-sided dice) while each individual die should provide any number in generally equal amounts. Further, use of multiple dice should allow for individual discrepancies in the statistical likelihood of any individual die to roll a particular value should to be cancelled out by unrelated discrepancies in the other die.

The randomness for a single throw within hard defined statistical values occurs because of the way dice are made. Traditional dice are formed as regular solid polyhedrons usually with an even number of sides or faces. These shapes typically provide clear faces, and distinct breaks between the faces, which will usually make is easy for the die to come to rest on a particular face with a face clearly facing upward as such orientations are the only ones stable within Earth's gravitational field. The most well known form of dice are cubical and have 6 sides/faces. However, other polyhedrons are also quite commonly used and dice which are 4-sided, 8-sided, 10-sided, 12-sided, and 20-sided are available at almost any store that supplies gaming equipment.

These types of non-6-sided dice are commonly used in certain types of games, such as, but not limited to, role-playing games where their difference in odds of any number coming up can be used to represent different types of events without need to change the actual number being rolled. For example, it is far more likely to roll a 3 or less on a 4-sided dice than it is on a 20-sided dice so rolling less than a 3 can be a standard action with simply the type of dice being used to attempt to roll it being used in different game play conditions. Further, 10-sided dice in particular can be valuable as two together can be used to roll a random percentage by treating one die as the 10's digit and the other as the 1's digit.

In most dice, the faces are labeled with numbers (usually going from 1 to the number of sides, although going from 0 to one less than the number of sides is also sometimes used—particularly with regards to 10-sided dice) although other symbols are also readily used and the face which is facing up when the die comes to rest is considered the rolled value. However, other systems can be used. For example, 4-sided dice in the form of tetrahedrons will come to rest not with a face but with a point or vertex facing upward. Thus, the points of such a dice may be labeled with each face actually having three labels corresponding to the three vertices of the face. Alternatively, instead of labeling the point that is up, the face that is down may be labeled (typically on an adjacent face actually identifying the edge which would be resting on the table where all three such edges of any face are similarly identified.

Solid polyhedrons are popular for dice because they are typically easy to form using virtually any known material and are also quite strong. Further, labeling of faces is easy and can be performed using indented indicators or even simply paint or ink. Regular polyhedrons also provide for each side theoretically having an even chance of coming up on top in any throw because of the regularity of their shape. Thus, the odds of any side of a 6-sided dice being obtained on any throw should be ⅙, the odds of any side of a 12-sided dice being obtained on any throw should be 1/12 and so on.

However, while polyhedral dice are well known, other forms of dice can be made having virtually any number of sides or structure. Dice in the form of disks, tops, cylinders, and even objects (such as pigs and wedges of cheese) can be formed. These dice, however, are often not designed to have even odds of any side coming up, but are often reliant on one or more sides being substantially easier or harder to roll.

While dice are an incredibly valuable gaming implement, they do have some interesting limitations. In the first instance, while mathematically the odds of a regular solid polyhedron landing on any side should be the same, it is also the case that building a mathematically accurate regular solid polyhedron can be extraordinarily difficult. In mathematical models, mass in the polyhedron is distributed perfectly evenly, which is a near impossibility even with the most advanced manufacturing techniques due to things such as air bubbles or manufacturing irregularities. Further, as an extreme example, the need to label the sides can result in slight changes in weight due to the method used adding or removing small amounts of mass from one side compared to another. These can all serve to make a dice not quite perfectly random and that will slightly favor landing in certain orientation(s) more than others.

Probabilistic anomalies introduced by these manufacturing issues, however, can pale in response to anomalies introduced by the throwing behavior of the human behind the dice. As a simple example, throwing the dice by hand on a flat surface without a high coefficient of friction (such as onto a card-based board game board) can often result in dice sliding instead of tumbling which can decrease the variables that they are exposed to and decrease their apparent randomness in selection of sides. Tumbling behavior is what should introduce the randomness in any dice throw. During tumbling, variables cannot be easily controlled or predicted and increased tumbling exposes a die to more unknown forces and tends to randomize any throw. Increased randomness across throws then tend to accurately direct the results of many throws to approach predicted mathematical probabilities.

Unfortunately, many standard game dice do not actually utilize full polyhedrons (those that do are often referred to as "perfect" dice) which can decrease tumbling behavior. Instead, such dice are often constructed with rounded edges and corners. These can make the dice more comfortable to hold (they lack sharp points) and can create surprisingly large savings in material use in their construction. However, the lack of sharp edges and points, can also result in decreased tumbling from interaction with the surface forcing the die to turn as if it is a lever about the fulcrum of its contact point with the surface. Further, many times dice, once they hit a flat surface, even if they do not slide, tend to roll around one axis. This often means that two of their faces (the ones on the sides as they roll and containing the axis the dice is rolling around) may have a dramatically reduced chance of coming up.

Many people who play tabletop war-games that involve rolling large numbers of dice together, picking up dice having a certain value, and then rerolling those dice often encounter this phenomenon. The side of a dice which is up when the dice is picked up often has a disproportionate effect on the side of the dice which is up on the associated follow-up throw because the dice tend to all tumble a particularly similar amount and often roll or slide across the surface instead of truly tumbling. As dice are typically manufactured with their sides in the same relative positions (e.g. on a 6-sided dice, the amounts on the opposing faces typically add to seven) should a large number of dice with the same value up be picked up together (which often decreases tumbling in the hand) and thrown together, a larger than expected amount of certain particular values will often occur because the side picked up and the opposing side (for example the "6" and the "1") are less likely to be on the sides of a rolling dice and, thus, slightly more likely than any of the other sides to come up in the throw.

There are a number of ways to try and deal with this phenomenon. One is the use of dice towers. These are typically tubular structures having complicated twisting pathways through them with a large number of sub-surfaces and often a high decree of friction. The goal of a tower is simply to force a dice that passes through it to tumble in a large number of different directions. In cases where regulated wagering is done, rules and structures to increase dice movement are also commonly employed. For example, a Craps table typically has a high friction felt surface (which discourages dice sliding and encourages more rolling and tumbling) and the dice used have sharp edges and points (as opposed to being rounded) for the same reason. Further, dice are typically required (or at least encouraged) to hit the table, then hit the wall (which is also typically covered in felt), and then return to the table forcing the dice to interact with surfaces in at least three different directions. This acts like a small version of a dice tower with each of these pieces serving to increase randomness of any given throw and making the throws, over time, better approach statistical averages.

While all the above systems work to increase randomness, there are a number of practical problems with using dice towers, polyhedrons with sharp edges and corners, and felt surfaces. The most noticeable of which is cost and space. These things all increase cost and increase the amount of space and materials required to throw the dice. Further, even if these weren't considerations, casino dice, because of their control to provide better individual randomness and combined averages more akin to statistical odds, are often simply boring to look at and lack differentiation from each other on purpose.

Most casino dice are red (or another single color) plastic and have "dot" marks to denote their numbers. Other than typically having a casino's name on them, they often look the same anywhere. In gaming, and particularly in gaming which is more personal and involves more personalization of game pieces such as in tabletop war-gaming or role-playing, people want their dice to be different and original. This allows for personalization of their dice to them (and often to match avatars, personas, and armies that they play the games with), helps to make sure a player uses their dice (and gets them back after the gaming session), and allows rolling of different looking dice to have different effects (for example for each to represent a specific act). This has led to the dice industry producing dice in a huge plethora of materials, colors, and even modified designs (such as dice that are hollow, for example) to allow for distinction and personalization between dice during the game and between players. However, as role-playing and war-gaming (and board gaming) are also become more player on player competitive, there is a concern that dice be not only attractive and individual, but also fair.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are dice which have a skeletal polyhedral form with faces that are separated from the edges of the polyhedron. The faces, however, are supported from internal to the polyhedron and the polyhedron utilizes a heavy generally spherical core to encourage improved tumbling behavior.

Described herein, among other things, is a die comprising: an outer frame formed as a skeletal polyhedron having edges and vertices, the skeletal polyhedron also defining a number of open sides; a core encompassing a center of the polyhedron, the core suspended from the outer frame by supports extending from the core to the vertices; and a series of faces, each of the faces connected to the core by a mount so that each of the faces appears suspended in one of the open sides and does not directly connect to any of the edges or the vertices.

In various embodiments of the die, the polyhedron is a tetrahedron, a cube, an octahedron, a decahedron, a dodecahedron, or an icosahedron.

In an embodiment of the die, the core is generally spherical.

In an embodiment of the die, the core includes at least 15% of the total mass of the die.

In an embodiment of the die, at least one of the faces includes an indicia which may be placed on the face or recessed into the face.

In an embodiment of the die, the frame comprises hard plastic.

In an embodiment of the die, the frame comprises metal.

In an embodiment of the die, the supports are generally cylindrical.

In an embodiment of the die, each of the faces is generally circular.

In an embodiment of the die, each of the faces is of generally similar shape to the open space the face is within.

In an embodiment of the die, the mounts are generally cylindrical.

In an embodiment of the die, each of the mounts are generally in the form of an inverted pyramidal frustum.

BRIEF DESCRIPTION OF THE DRAWINGS

FIG. 1A provides a top view, FIG. 1B provides a perspective view, FIG. 1C provides a side view, and FIG. 1D provides a sectional view along the line A-A in FIG. 1C.

FIG. 2A provides a top view, FIG. 2B provides a perspective view, FIG. 2C provides a side view, and FIG. 2D provides a sectional view along the line A-A in FIG. 2C.

FIG. 3A provides a perspective view, FIG. 3B provides a side view, and FIG. 3C provides a sectional view along the line A-A in FIG. 3B.

FIG. 4A provides a top view, FIG. 4B provides a perspective view, FIG. 4C provides a side view, and FIG. 4D provides a sectional view along the line A-A in FIG. 4C.

FIG. 5A provides a top view, FIG. 5B provides a perspective view, FIG. 5C provides a side view, and FIG. 5D provides a sectional view along the line A-A in FIG. 5C.

FIG. 6A provides a top view, FIG. 6B provides a perspective view, FIG. 6C provides a side view, and FIG. 6D provides a sectional view along the line A-A in FIG. 6C.

DETAILED DESCRIPTION OF PREFERRED EMBODIMENTS

Figure 1B:
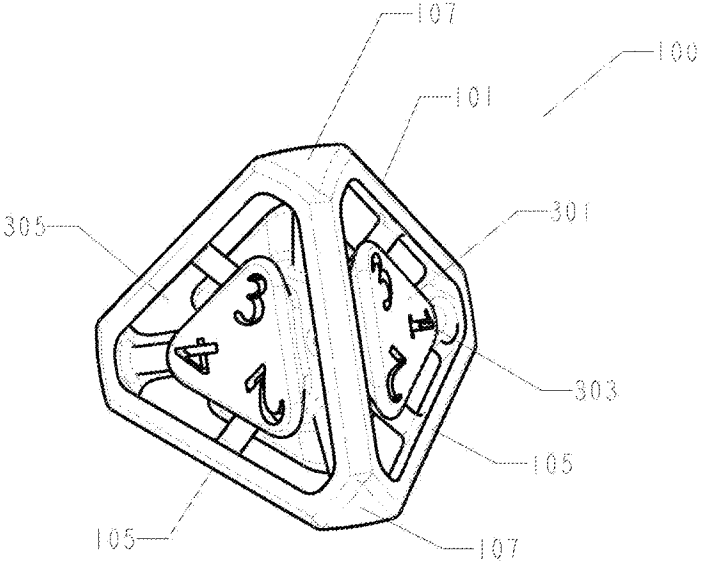
FIGS. 1A, 1B, 1C, and 1D provide for various views of an embodiment of a 4-sided die in accordance with this disclosure.

This disclosure is generally directed to dice and methods for making dice. In particular, this disclosure is directed to dice which have the exterior form of regular polyhedrons, but are not solid polyhedrons. Instead, the dice, when viewed externally, are in the form of skeletal polyhedrons with floating faces. The dice also include a solid core surrounding their center which can serve to improve tumbling behavior as well as supporting the faces allowing them to be disconnected from any of the edges or vertices of the polyhedron's sides. It should be recognized that dice can have virtually any number of faces and markings on those faces and, thus, the fact that this disclosure primarily discusses and depicts dice which are 4-sided, 6-sided, 8-sided, 10-sided, 12-sided, and 20-sided in no way is intended to limit the sizes or shapes of dice which can be made using the structures contemplated herein.

Further, it should be recognized that the terms "faces" and "sides" are often used interchangeably when referring to the flat generally planar surfaces of a solid polyhedral die. For this reason, the two terms may be used interchangeably herein. However, because of the specific nature of the structure of the present dice which have a generally skeletal form, the term "side" will generally be used to refer to the plane of the die which would be solid should the die be a solid polyhedron while the term "face" will generally be used to refer to the actual generally planar surface which holds the die indicator associated with that side.

Finally, it should also be recognized that the term "randomness" when applied to the rolling of dice is slightly different than with regards to other random behavior. Specifically, every die actually generates rolls (if it tumbles sufficiently and has sufficient surface interactions) which orientate each of its faces (and associated indicator thereon) to a chosen position (e.g. "up") a number of times which is perfectly accurate statistically to the odds of such orientation occurring. The goal of a "random" die is not to alter this mathematically immutable rule of die rolling, but to make each side of the die as close to equally likely as possible.

For example, a perfectly "random" 6-side die would actually have the odds of rolling each of its six sides be exactly equal to the others and exactly ⅙. A "loaded" or "crooked" die on the other hand attempts to provide a die which looks like it should have equal probability of rolling each side while it actually does not due to modification. For example, a cubical die could be weighted in such a way (loaded) or formed in such as way (crooked) as to make it slightly more likely that a "6" would be rolled than any other number. In tumbling behavior within normal gravitational fields of the earth, a heavier or larger side should be more likely to end up "down" because it takes more energy to shift the die from this positon than from any other.

While a die with perfectly equal likelihood of any side coming up is readily obtainable in mathematical modeling and theory, such perfect "randomness" is not attainable in the real world. Specifically, the nature of matter does not allow for perfectly distributed mass in any real space. However, careful manufacturing can get asymptotically closer to such theoretical modeling. Further, as contemplated in the background of this disclosure, much of the randomness of die rolling is actually obtained through more accurate human rolling behavior, rolling surfaces, and resultant die tumbling.

If one could measure the values of all variables representing every interaction with a die at the instant it was rolled and had its initial position, one could calculate the rolled side with perfect accuracy. However, practical mathematics (and chaos theory) have recognized that such calculations are practically impossible. Further, controlling rolling behavior of a human, and the structure of the surface the die is rolled on, are outside the designs of a die. Therefore, designs of dice which increase the number of interactive variables are typically more random than other designs and variables are typically increased by increasing randomness within a die's tumbling behavior when thrown. Thus, designs of dice herein are generally intended to improve tumbling behavior of the dice, even when thrown in less than ideal conditions.

FIGS. 1A-6D show various images of dice that have a generally skeletal polyhedral form with floating faces and a heavy central core in accordance with the present disclosure. FIGS. 1A, 1B, 1C, and 1D provide for various views of an embodiment of a 4-sided die, FIGS. 2A, 2B, 2C, and 2D provide for various views of an embodiment of a 6-sided die, FIGS. 3A, 3B, and 3C provide for various views of an embodiment of a 8-sided die, FIGS. 4A, 4B, 4C, and 4D provide for various views of an embodiment of a 10-sided die, FIGS. 5A, 5B, 5C, and 5D provide for various views of an embodiment of a 12-sided die, and FIGS. 6A, 6B, 6C, and 6D provide for various views of an embodiment of a 20-sided die. As the structure of each die is generally similar, the various different polyhedrons will be discussed together and common labels are used across each figure except to the extent that a particular label and/or discussion is only of particular relevance to a particular sub-group of FIGS.

The dice of the FIGS. are all generally constructed to have regular polyhedral forms which, if solid, would comprise regular platonic polyhedral solids. In FIGS. 1A-1D, this is a tetrahedron; in FIG. 2A-2D, this is a cube; in FIGS. 3A-3C, this is a octahedron; in FIGS. 4A-4D this is a decahedron; in FIGS. 5A-5D this is a dodecahedron, and in FIG. 6A-6D this is an icosahedron. Instead of being platonic polyhedral solids, however, as can be seen in the FIGS., the polyhedral shape has been reduced by the general elimination of some of the structure of the sides (103) to create a skeletal frame (101) which serves to use the edges (105) to define open gaps (305) in the sides (103). This results in the edges (105) having a generally narrow structure interconnecting adjacent vertices (107) making the overall frame (101) be of the form of a skeletal polyhedron. The amount of the reduction can be anything, but will typically result in edges (105) which are quite narrow and will often be as thin as possible while still providing the die (100) with sufficient strength to not collapse under normal use. Thus, the edges (105) may be thinner, for example, if the die is constructed of metals versus if it is constructed of plastics. The dice (100) may be constructed of any sufficiently rigid material and these two options are merely exemplary. In a metal die, an edge (105) preferably extends only a small distance into that side (103) leaving the vast majority of the side open (305).

Figure 1D:
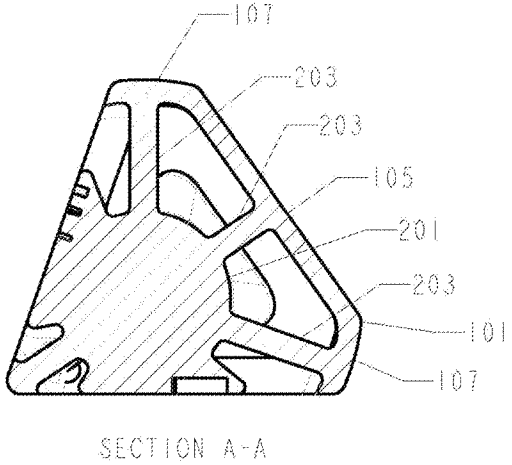
Figure 1A:
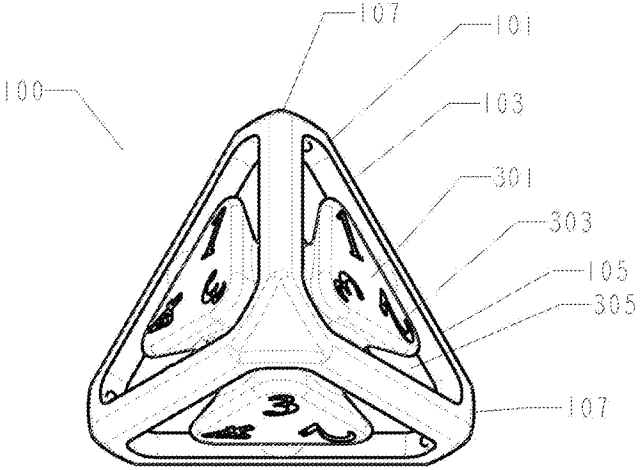
Figure 1C:
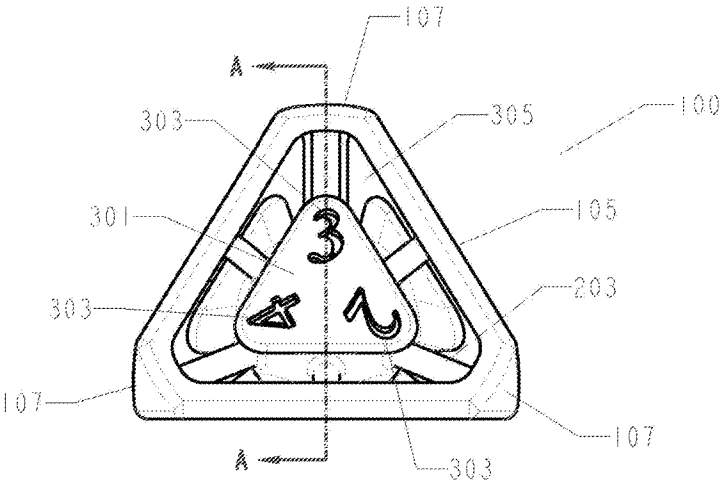
Figure 3A:
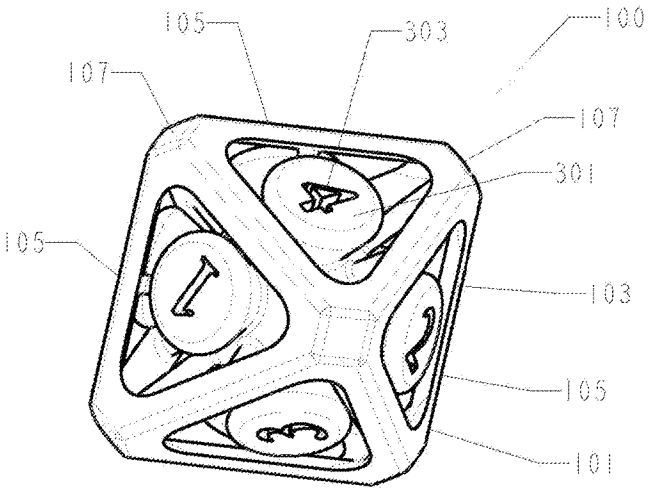
FIGS. 3A, 3B, and 3C provide for various views of an embodiment of a 8-sided die in accordance with this disclosure.
Figure 3C:
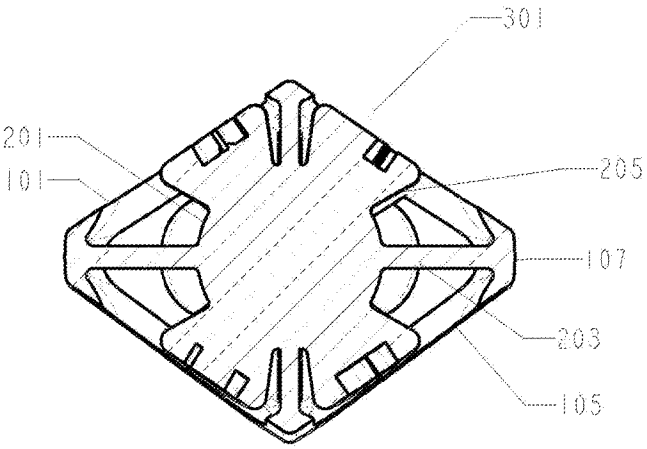
Figure 3B:
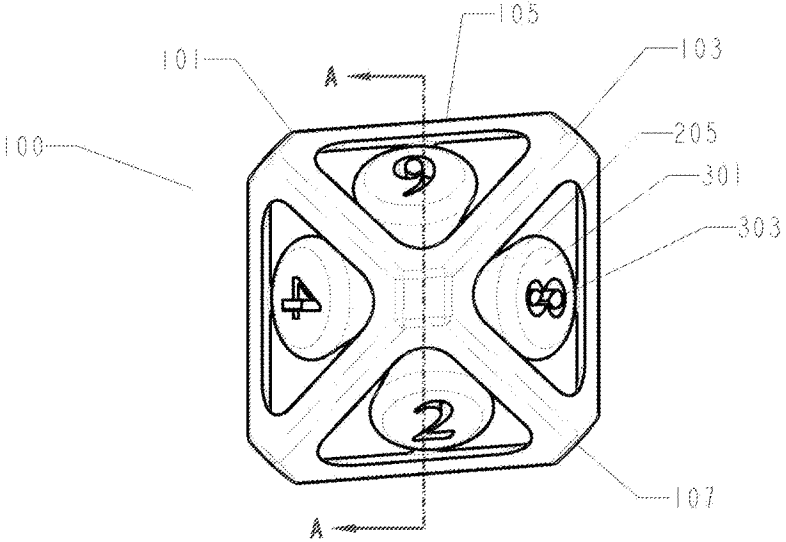
Figure 6A:
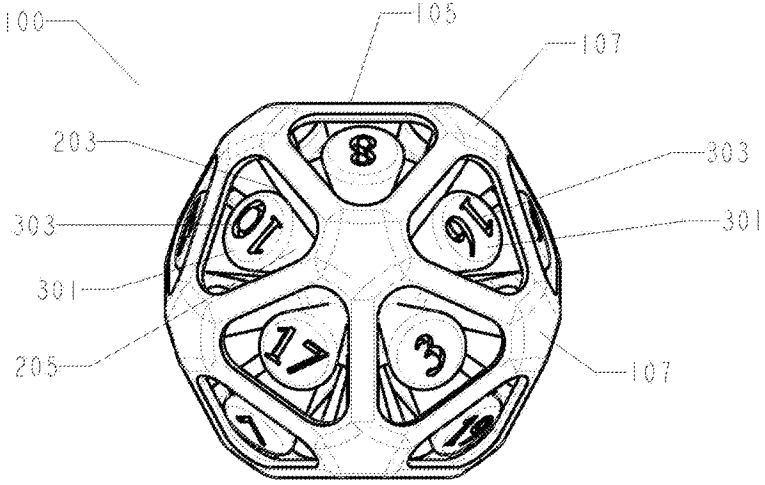
FIGS. 6A, 6B, 6C, and 6D provide for various views of an embodiment of a 20-sided die in accordance with this disclosure.
Figure 6B:
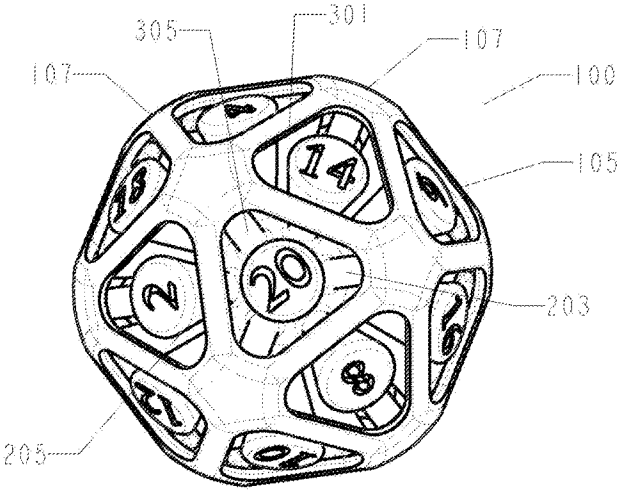
Figure 6C:
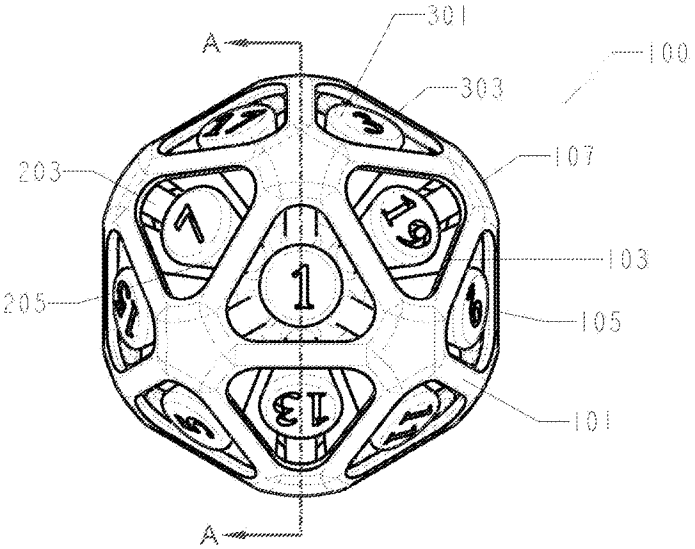
Figure 6D:
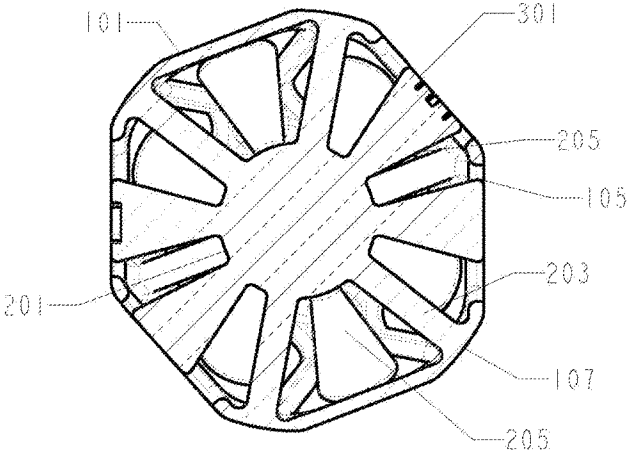

Further, in the depicted embodiments, each of the edges (105) is not a sharp line but has been flattened to provide the edge (105) with either a slightly planar surface (as depicted in FIG. 1B or 3A, for example) or, with a convex arcuate rounded surface (as depicted in FIG. 6B, for example). The rounding or cutting off of the edge (105) serves to both save material in construction and also makes the dice (100) smoother to the touch and without sharp edges. Similarly, the vertices (107) may also be flattened from sharp points to have either small generally planar surfaces (as can be seen in FIG. 1C or 3B) so simply to be rounded (as can be seen in in FIG. 6C). This, again, saves material and produces a smoother feel by eliminating sharp points.

As is also visible in the FIGS., the space internal to the edges (105) (between the edges (105) and the core (201)) is typically also removed in the course of making the skeletal shape. Thus, the edges (105) are akin to thin "bones" connecting adjacent vertices (107) and which do not directly contact any other portion of the die (100) except where they meet at adjacent vertices (107). The edges (105), thus, define the edges of the regular polygons that form the sides of each die (100).

In order to improve the rolling of the dice, each die (100) will typically include a generally solid core (201). The core (201) will typically be positioned surrounding the center point of the polyhedron of the outer frame (101) making it internal to the skeleton of the outer frame (101) and within the polyhedron of the die (100). As can be seen in the depicted embodiments, the core (201) will be generally spherical so as to evenly distribute mass about the center of the polyhedron and to provide the greatest mass toward the center of the polyhedron. It should be recognized that in alternative designs, the core (201) could be of shapes other than generally spherical. For example, the shape may be cubical or may be a solid or skeletal polyhedron corresponding in shape to the skeletal polyhedron of the frame (101).

Regardless of shape, however, the core (201) will preferably have it's mass distributed generally evenly around the center of the polyhedron shape of the die (100). The core (201) will typically comprise at least 15% of the total mass of the die. Depending on the embodiment, this may comprise at least 15%, at least, 20%, at least 25%, at least 30%, at least 35%, or at least 40% of the total mass. Regardless of the percentage of the total mass of the die (100) in the core (201), that mass will typically be as focused to toward the center of the polyhedron as commercially possible. Further, it will often be the case that as the number of sides (103) increase the percentage of the total mass in the core (201) will decrease, but this is by no means required.

In an embodiment of the 4-sided die of FIGS. 1A, 1B, 1C, and 1D the core (201) may be about 40% of the total mass of the die. In an embodiment of the 6-sided die of FIGS. 2A, 2B, 2C, and 2D the core (201) may be about 25% of the total mass of the die. In an embodiment of the 8-sided die of FIGS. 3A, 3B, and 3C the core (201) may be about 30% of the total mass of the die. In an embodiment of the 10-sided die of FIGS. 4A, 4B, 4C, and 4D the core (201) may be about 35% of the total mass of the die. In an embodiment of the 12-sided die of FIGS. 5A, 5B, 5C, and 5D the core (201) may be about 15% of the total mass of the die. In an embodiment of the 20-sided die of FIGS. 6A, 6B, 6C, and 6D the core (201) may also be about 15% of the total mass of the die.

The core (201) will generally be of solid material. Typically, it will be constructed of the same material as the frame (101) but that is by no means required and in an alternative embodiment the core (201) material may be purposefully chosen so as to be of a heavier and denser material (or a lighter material) than the frame (101) which may provide for additional lever action during rolling as contemplated later in this disclosure. Regardless of the specific construction of the core (201), the core (201) is typically suspended from the frame (101) using a series of supports (203). Each support (203) will typically be generally cylindrical in the depicted embodiment and one support (203) will generally extend from the core (201) to each of the vertices (107) of the frame (101). The supports (203) will typically have a dimeter no larger than the width of the edges (105) but that is not required. In this way, the core (201) is effectively suspended in the center of the polyhedron forming the die (100) by a small number of connections (supports (203)).

Further, as the supports (203) will typically be thin, they can serve to provide strength to the frame (101) and maintain the location of the core (201) therein without imparting large amounts of weight toward the outer frame (101). Further, by interconnecting one support (203) to each vertex (107) of the frame (101), the mass imparted by the supports (203) is generally evenly distributed throughout the polyhedron of the die (100) which avoids any side having increased mass over the other sides. Specifically, the mass of the supports (203) is actually positioned between the sides (105) in many respects and also, because of the polyhedral shape of the die (100), each support (203) has another positioned with its major axis on common line through the core (201) and through the center of the frame (101).

In order to provide markings on the die (100), each side (103) defined by the frame (101) includes a face (301). The face will include marking indicia (303) appropriate to the face (301) and the purpose of the die (100). In the embodiments of the present figures, these are in the form of Arabic numerals. However, it would be apparent to those of ordinary skill in the art that any form of indicia (303) may be used. Further, the method for providing the indicia (303) on each face (301) may be in any manner known to one of ordinary skill. For example, as in the depicted embodiments, the indicia (303) may comprise recessed figures (which may or may not be filled with a contrasting material to be more easily visible), may be painted or inked onto the surface of the face (301), or may be formed by other techniques such as the application of adhesive decals. In a still further embodiment, the indicia (303) and face (301) may be combined in a fashion where the face (301) is formed into a shape indicative of the indicia (303). For example, the face (301) may be in the form of a polygon having a number of sides corresponding to the number of that face (301) or may be formed into a representation of a numeral or letter.

Figure 2A:
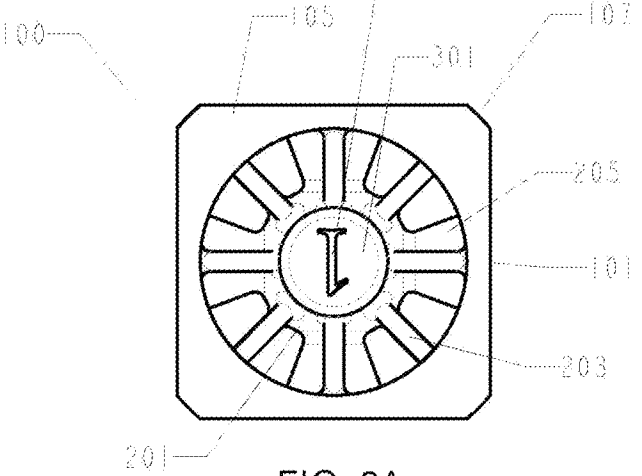
FIGS. 2A, 2B, 2C, and 2D provide for various views of an embodiment of a 6-sided die in accordance with this disclosure.
Figure 2B:
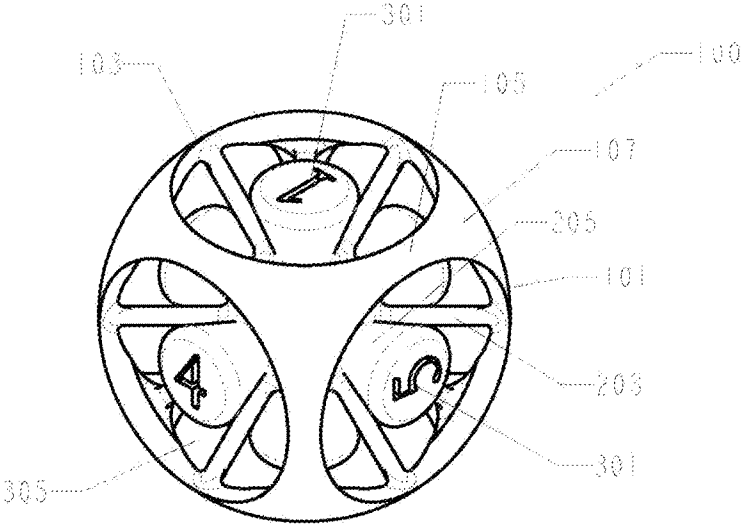
Figure 2C:
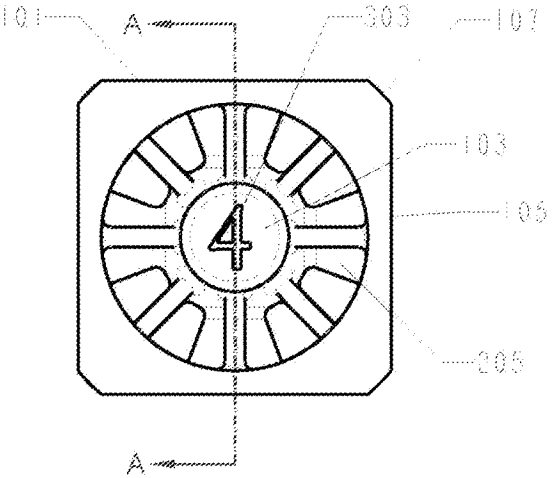
Figure 4A:
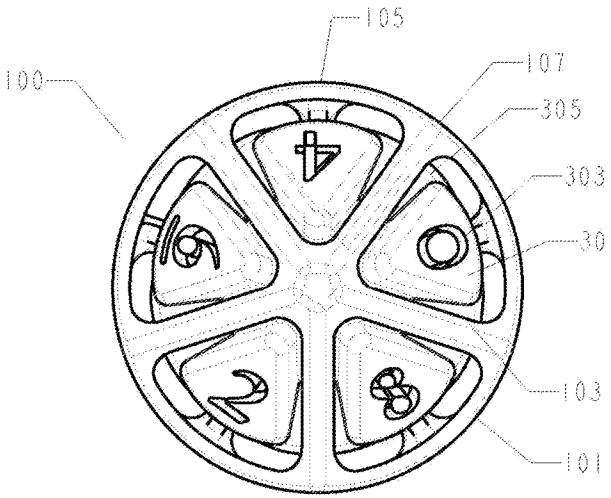
FIGS. 4A, 4B, 4C, and 4D provide for various views of an embodiment of a 10-sided die in accordance with this disclosure.
Figure 4B:
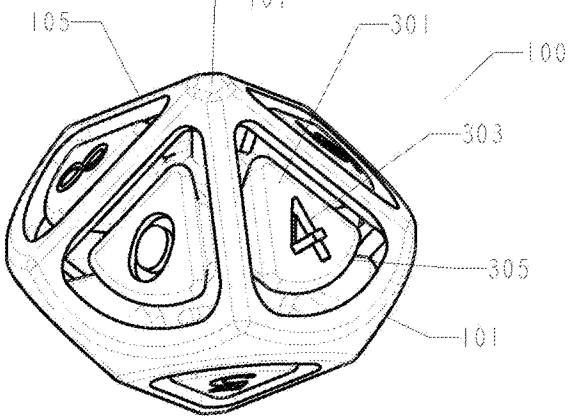
Figure 4C:
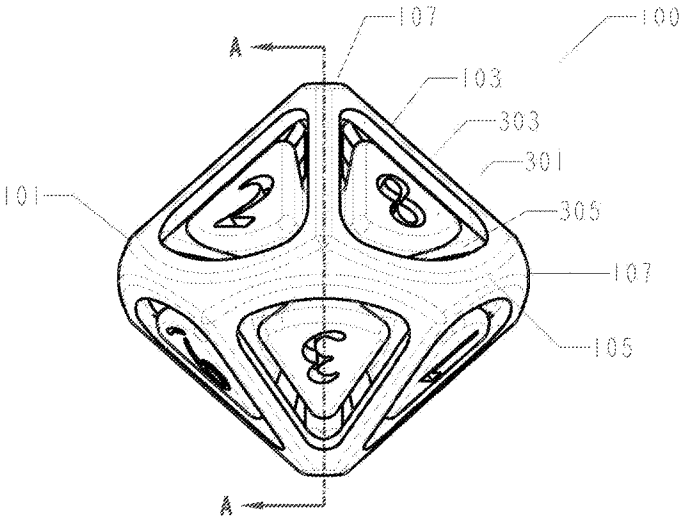
Figure 5A:
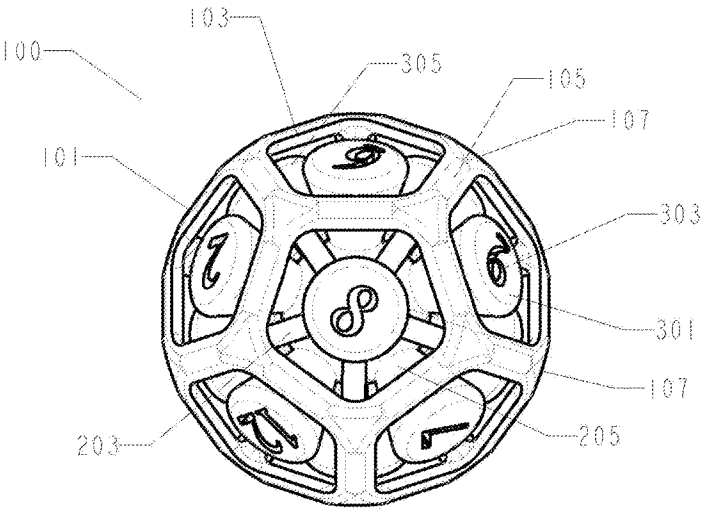
FIGS. 5A, 5B, 5C, and 5D provide for various views of an embodiment of a 12-sided die in accordance with this disclosure.
Figure 5B:
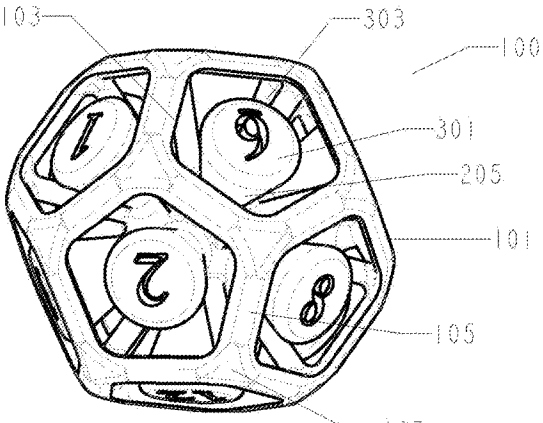
Figure 5C:
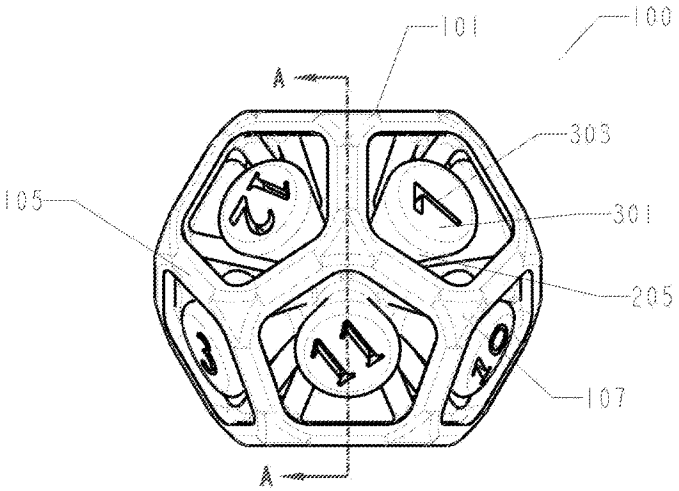
Figure 5D:
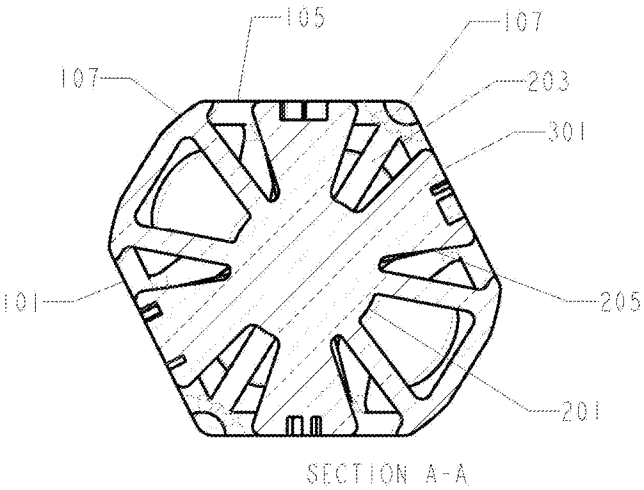

As can be seen from the FIGS., the faces (301) will generally be planar and may be of any shape including, but not limited to, circular (as shown in FIG. 2A or 5A, for example) or a shape corresponding the shape of the side (as shown in FIGS. 1C and 4B, for example) and will generally be arranged so as to have a planar outer surface which to be generally co-planar with the plane formed from the outer surfaces of the edges (105) that surround the face (301). This effectively forms a planar side (103) of the polyhedron but including gaps which are the remains of the open sides (305) not filled by the face (301) as shown in the FIGS. Each face (301) does not extend to contact, and is not connected to, the neighboring edges (105) or vertices (107) and has no support interconnection to any edges (105) or vertices (107). This gives a completely open "moat" surrounding the face (301) with the remaining portion of the open gap (305) and serves to visibly separate the face (301) from the edges (105) and vertices (107). This makes each face (301) appear to "float" in the middle of the open gap (305) of the polyhedral die (100) while still also giving the side (103) a generally planar outer surface for rolling. This can increase the friction and contact between the structure of any side of the polyhedron and any surface the die (100) is tumbling on.

Figure 2D:
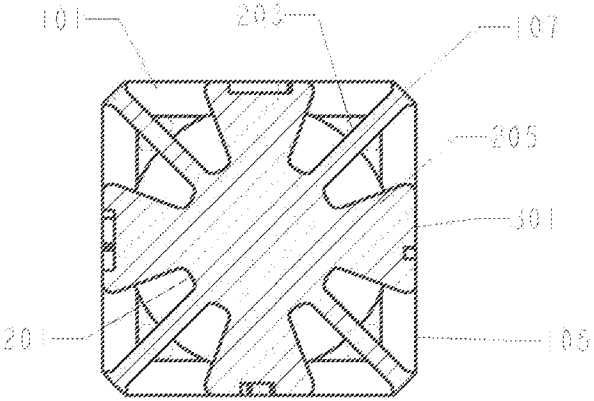
Figure 4D:
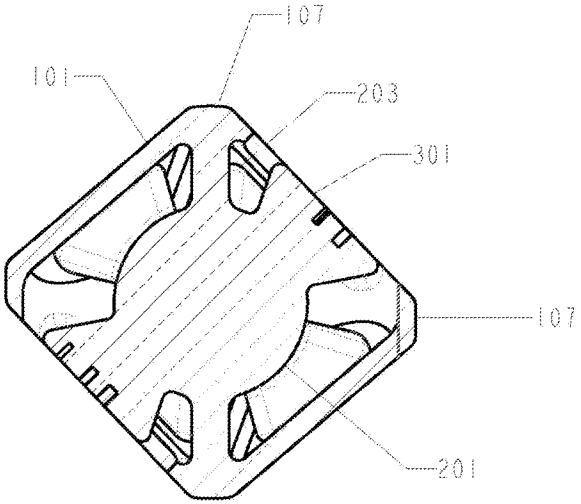

The faces (301) will typically be supported by a mount (205). The mount (205) may be of any shape but will generally be cylindrical as shown in FIG. 1D, may be in the shape of an inverted conical frustum as shown in FIG. 2D, or may be in the shape of an inverted pyramidal frustum having a base of any polygon or other shape such as is shown in FIG. 4D. Typically, the mount (205) will either be cylindrical to save on material while still providing sufficient support to keep the face (301) from moving, or will be a frustum corresponding to the related face (301) shape. The frustum form in particular allows for the mount (205) to generally not be readily visible from the side of the face (301) that it supports since the diameter shrinks as it approaches the core (201), which further improves the "floating" illusion of the face (301), while still resulting in a face (301) that can resist deformation at its edges toward the center of the polyhedron by increasing the thickness of the material at those edges.

The dice (100) of the FIGS. provide for a completely new appearance with the floating appearance of the face (301) and generally skeletal frame (100) structure being solely supported by the core (201) and vice-versa. These dice (100) are also believed to provide for improved randomness over other skeletal form dice and be more akin to solid "perfect" dice. In particular, by having a lot of mass, ideally at least 15% of the total mass, of the total mass of the die at a suspended and solid central core (201), this can increase the precision of the amount of mass placed (and its location) as well as more equally distributing the mass about the center of the polyhedron via precise manufacturing methods.

It should be recognized that the unique geometry of the dice of the FIGS. does not lend itself to traditional manufacturing techniques such as molding or machining. For this reason, the dice of the FIGS. will commonly be constructed using additive manufacturing techniques (3D printing) although that is by no means required. Further, such resultant prints may then be plated, painted, or otherwise have a coating applied thereto to alter the resultant appearance.

Having the mass of the core (201) suspended about the center is also believed to assist the die (100) in acting as a $3^{rd}$ class lever when thrown. In particular, the core (301) acts as the load against the fulcrum of the face (301), edge (105), and/or vertex (107) which is contacting the rolling surface at any instant. As the skeletal structure provides relatively little mass compared to the core (201), this improves efficiency of the lever and is believed to improve tumbling behavior of the die (100). The outer frame (101) above the suspended core (201) and fulcrum point also serves to impart increased angular momentum from the suspended center of mass as it attempts to continue motion past the fulcrum which has become a friction point thus resulting in an increased chance or rolling forward over the fulcrum and imparting another function to increase the randomness of the roll. Further, the surfaces of the faces (301) combined with the corresponding surfaces of the edges (105) creating a generally planar side of the polyhedron can increase surface friction of any side (103) when contacting a rolling surface which can also increase tumbling behavior than if the face (301) was extended from or recessed into the side where only the skeletal from (101) or face (301) would contact the surface.

While the invention has been disclosed in conjunction with a description of certain embodiments, including those that are currently believed to be useful embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The qualifier "generally," and similar qualifiers as used in the present case, would be understood by one of ordinary skill in the art to accommodate recognizable attempts to conform a device to the qualified term, which may nevertheless fall short of doing so. This is because terms such as "spherical" or "planar" or any of the polyhedral forms contemplated herein are purely geometric constructs and no real-world component or relationship is truly such a shape in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers on any such mathematical term to include a range of variations from the literal geometric meaning of the term in view of these and other considerations.

The invention claimed is:

1. A die comprising:

an outer frame formed as a skeletal polyhedron having edges and vertices, said skeletal polyhedron also defining a number of open sides;

a core encompassing a center of said polyhedron, said core suspended from said outer frame by supports extending from said core to said vertices; and a series of faces, each of said faces connected to said core by a mount so that each of said faces appears suspended in one of said open sides and does not directly connect to any of said edges or said vertices.

2. The die of claim 1 wherein said polyhedron is a tetrahedron.

3. The die of claim 1 wherein said polyhedron is a cube.

4. The die of claim 1 wherein said polyhedron is an octahedron.

5. The die of claim 1 wherein said polyhedron is a decahedron.

6. The die of claim 1 wherein said polyhedron is a dodecahedron.

7. The die of claim 1 wherein said polyhedron is an icosahedron.

8. The die of claim 1 wherein said core is generally spherical.

9. The die of claim 1 wherein said core includes a includes at least 15% of the total mass of said die.

10. The die of claim 1 wherein at least one of said faces includes an indicia.

11. The die of claim 10 wherein said indicia is placed on said face.

12. The die of claim 10 wherein said indicia is recessed into said face.

13. The die of claim 1 wherein said frame comprises hard plastic.

14. The die of claim 1 wherein said frame comprises metal.

15. The die of claim 1 wherein said supports are generally cylindrical.

16. The die of claim 1 wherein each of said faces is generally circular.

17. The die of claim 1 wherein each of said faces is of generally similar shape to said open space said face is within.

18. The die of claim 1 wherein said mounts are generally cylindrical.

19. The die of claim 1 wherein each of said mounts are generally in the form of an inverted pyramidal frustum.

* * * * *